US005382964A

United States Patent [19]

Schneider

[11] Patent Number: 5,382,964

[45] Date of Patent: Jan. 17, 1995

[54] PRINTING APPARATUS WITH THERMO TRANSFER FOIL CAPABLE OF COMPENSATING VARIATIONS IN SPACING OR PRESSURE BETWEEN A PRINTER FORME CARRIER AND A RECORDING HEAD

[75] Inventor: Josef Schneider, Doedorf-Lettenbach, Germany

[73] Assignee: MAN Roland Druckmaschinen AG, Offenbach am Main, Germany

[21] Appl. No.: 949,271

[22] Filed: Sep. 11, 1992

Related U.S. Application Data

[63] Continuation of Ser. No. 598,112, Oct. 16, 1990, abandoned.

[30] Foreign Application Priority Data

Dec. 14, 1989 [DE] Germany ..... 3941303

[51] Int. Cl.[6] ..... B41C 1/005; B41C 1/06; B41J 2/325

[52] U.S. Cl. ..... 346/76 PH; 101/467; 101/465; 101/466; 101/463.1

[58] Field of Search ..... 101/465, 466, 467, 463.1; 346/76 PH

[56] References Cited

U.S. PATENT DOCUMENTS

| | | | |
|---|---|---|---|
| 4,565,737 | 1/1986 | Nishide | 428/321.5 |
| 4,897,310 | 1/1990 | Beyer et al. | 428/412 |
| 4,958,564 | 9/1990 | Fuhrmann et al. | 101/467 |
| 5,002,819 | 3/1991 | Tohma et al. | 428/488.4 |
| 5,072,671 | 12/1991 | Schneider et al. | 101/467 |
| 5,191,834 | 3/1993 | Fuhrmann et al. | 101/130 |

FOREIGN PATENT DOCUMENTS

| | | | |
|---|---|---|---|
| 0321388 | 6/1989 | European Pat. Off. . | |
| 3248178 | 7/1984 | Germany . | |
| 3416067 | 11/1984 | Germany . | |
| 041547 | 2/1986 | Japan . | |
| 61-110593 | 5/1986 | Japan | B41M 5/26 |
| 61-162392 | 6/1986 | Japan | B41M 5/26 |
| 61-41547 | 7/1986 | Japan . | |
| 0060751 | 3/1988 | Japan . | |
| 63-00751 | 8/1988 | Japan . | |
| WO84/02494 | 7/1984 | WIPO . | |

OTHER PUBLICATIONS

Benning, "Plastic Foams, vol. 2, " Wiley: New York: 1969 pp. 39–41.

*Primary Examiner*—Benjamin R. Fuller
*Assistant Examiner*—Huan Tran
*Attorney, Agent, or Firm*—Frishauf, Holtz, Goodman & Woodward

[57] ABSTRACT

To compensate for tolerances and variations in tolerances in a recording system in which a thermal transfer foil is passed between a image recording element (3) and a printing form carrier (1), the thermal transfer foil, for example of a polyester base (9), has an intermediate layer (8) applied thereto on which a meltable substance layer (7, 7'), for example on a polyethylene base, is located. The intermediate layer (8) is thermally volume expandable, by including therein either a foaming agent or moisture or other gas which, upon application of heat, causes foaming or the formation of gas or steam bubbles to expand its volume. Tolerances 6 of up to about 1 mm, thus, can be compensated and pressure variations and surface variations between the thermal image recording element (3) and the form carrier (1) are no longer critical. The accuracy and sharpness of transfer of meltable particles from the meltable layer (7) to the form (1) is not affected by the presence of the thermally expandable layer which, upon influence of heat, will expand only after the meltable substance has melted, due to a selection of thermal expansion material, for example foaming agent, which has a threshold or foaming temperature higher than the melting temperature of the meltable substance (7).

12 Claims, 1 Drawing Sheet

PRINTING APPARATUS WITH THERMO TRANSFER FOIL CAPABLE OF COMPENSATING VARIATIONS IN SPACING OR PRESSURE BETWEEN A PRINTER FORME CARRIER AND A RECORDING HEAD

This application is a continuation of application Ser. No. 07/598,112, filed Oct. 16, 1990 now abandoned.

Reference to related applications, assigned to the assignee of the present application, the disclosures of which are hereby incorporated by reference:

U.S. Ser. No. 07/430,511, filed Nov. 1, 1989, Schneider et al, now U.S. Pat. No. 5,072,671

U.S. Ser. No. 07/417,299, filed Oct. 5, 1989, Fuhrmann et al, now U.S. Pat. No. 4,958,564

U.S. Ser. 07/418,137, filed Oct. 6, 1989, Fuhrmann et al and continuation Ser. No. 07/609,009, filed Oct. 29, 1990, now U.S. Pat. No. 5,191,834

Reference to related publication:

German Patent 32 48 178, by the inventor hereof, Josef Schneider.

FIELD OF THE INVENTION

The present invention relates to a transfer foil which carries particles which can be heated, and which then melt. These particles can be small enough so that a point-by-point transfer thereof to a printing forme can be obtained to thereby render the printing forme, selectively, hydrophobic or hydrophilic.

BACKGROUND

German Patent 32 48 178, by the inventor hereof, describes an offset printing machine in which, for repeated imaging of a printing forme cylinder, a thermal transfer foil is so activated that hydrophobic substances on a substrate of the foil can be transferred to the forme so that, upon printing, they will accept ink to form inked regions or points on the forme, for subsequent printing on a substrate, or offsetting on an offset cylinder. The transfer foil can be heated by point-heat sources to provide for selective melting of spots or points of the meltable layer on the foil.

Precise transfer of image points of equal size requires that, upon each contact of the heating element of the image recording head with the back side of the substrate of the foil, it transfers the same quantity of heat thereto; further, the mechanical pressure arising in the chain of transfer to the printing forme cylinder must be the same. Even highest accuracy in manufacture of the recording head and all components of the transfer chain cannot eliminate some deviations in spacing and thickness of the transfer foil. Further, roughness of the surface of the forme cylinder causes changes in transfer capability. The changes or variations or tolerances from a design value may be tiny, for example in the region of only a few or several thousands of a millimeter. Yet, variations in printing line contacts or pressures occur, which either cause non-uniform reproducible transfer of image points or particles, with equal energy supply or, in a worst case, make such transfer impossible.

DEFINITION

As used herein, the term "pointed" or "spotted" with reference to application of heat to the foil is intended to mean point or spot application in selected areas thereof, to provide transfer of tiny particles.

The term "thermally volume expandable" as used herein is intended to mean a material which can foam, thereby expanding its volume, upon addition of a foaming agent; or which can be made to expand by heating captured or included moisture to form steam, or otherwise heating to liberate gases and thereby cause expansion.

THE INVENTION

It is an object to improve a thermal transfer foil, particularly for use in methods and apparatus described in the referenced applications and in the above-referenced German Patent 32 48 178, which can compensate for variations in spacing or pressure occurring in associated apparatus with which the tape is being used, and particularly to compensate for changes which occur between a thermal printing head and the surface of a printing forme.

Briefly, the transfer foil, tape, or the like is formed by a substrate on which a layer of a meltable substance, which, upon transfer to a printing forme carrier, is hydrophobic, or otherwise changes characteristics is applied. In accordance with a feature of the invention, the foil or tape further includes an intermediate layer located between the substrate and the meltable substance layer. The intermediate layer is formed of a material which is thermally volume expandable, and which has a volume expansion threshold temperature which is higher than the melting point of the meltable substance.

The use of the foil has the advantage that variations in spacing or pressure of apparatus with which the foil is to be used up to about 1 millimeter can be compensated. Thus, requirements regarding accuracy of surface formation and dimension of the printing forme, especially of a printing forme cylinder, and of the recording head, can be substantially decreased. Direct imaging of printing forme cylinders, thereby, becomes substantially simpler, much less expensive, and provide higher quality reproduction.

DRAWINGS

FIG. 1 is a highly schematic side view of a system for directly imaging a printing forme cylinder by use of a thermal transfer foil;

FIG. 2 highly enlarged cross-sectional view illustrating the layers of a transfer foil in accordance with the present invention; and FIG. 3 is a view similar to FIG. 2 and illustrating another embodiment.

DETAILED DESCRIPTION

Figure 2:
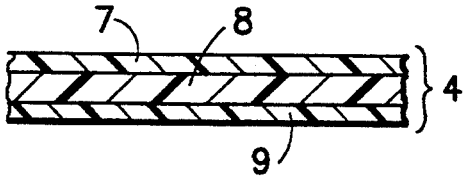

A printing forme cylinder 1 is engaged against a thermal transfer foil 4. The thermal transfer foil 4 is moved by a suitable transport apparatus having two transport rollers 5, 6. An image recording element 3 has a plurality of individually activatable heater elements 2 thereon. The thermal transfer foil 4 is so placed between the forme cylinder 1 and the image recording element 3 that the substrate or carrier layer 9 (FIG. 2) is placed against the image recording element 3, whereas a thermally meltable layer 7 is in contact with the cylinder 1.

In accordance with the present invention, an intermediate layer 8 is located between the substrate or carrier layer 9 and the meltable layer 7. The intermediate layer 8 is formed of, or includes a material which is thermally volume expandable, that is, which can foam, or expand its volume, under influence of heat, and which, further, is so arranged that the threshold or response temperature for foaming or volume expansion is higher than the melting temperature of the melt able substance of layer 7.

Figure 3:
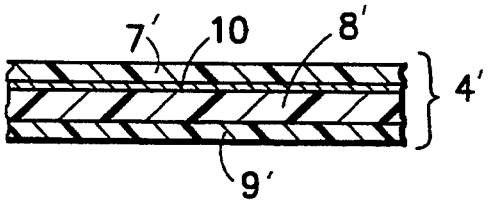

FIG. 3 illustrates another embodiment of the invention, in which, between a layer 8' of thermally volume expandable material and a layer 7' of meltable substance, a release layer or separating layer 10 is located, which favors release of the molten substance 7' from the foil 4', carried by a substrate 9'.

The carrier layer 9, 9' is made of a material which is dimensionally stable both in longitudinal and transverse direction; it is hardly or only very slightly compressible in its thickness dimension, and has a good heat conduction characteristic.

Layer 9 may, for example, be made of polyethyleneglycol-terephthalic acid ester.

The layer 8 of thermally volume expandable material may, for example, be made of a thermoplastic man-made material, or of a mixture which includes thermoplastic man-made material, and a foaming agent. The concentration of foaming agent may be between about 0.3 to 1.5%, and preferably between about 0.6–1%.

Mixing and handling of the materials can be conventional, in accordance with customary methods in the manufacture of plastics. The material of the layer 8 can be applied, for example by painting-on or calendaring of the material on the substrate 9. The thickness of the layer 8 may be between about 0.002 to 0.01 mm, preferably between about 0.002 and 0.004 mm thickness. An hydrophobic or, in other words, oleophilic layer 7 is applied thereover, having a thickness of between about 0.003 to 0.006 mm. The hydrophobic layer 7 which, preferably, is highly oleophilic, i.e. highly ink accepting, has a softening temperature which is below that of the dissociation temperature of the foaming material. It can be applied by painting on, striping on, as a dispersion or the like.

EXAMPLE 1

70 parts polyethylene granulate, with a melting point of 130° C. is kneaded together with 1 part granulate Luvopor ABF/50 G-EVA (ethylene vinyl acetate) of the organization Lehmann+Voss, of Germany. "Luvopor" contains 50% azodicarbamide; it has a dissociation temperature of 215° C. The kneading-together is carried out at 170° C. It is then painted on the polyester substrate 9 in form of a layer 8 of about 0.003 mm thickness. The layer 7 is then applied as a painted-on or spread-on layer of 0.005 mm thickness. A suitable substance is a mixture of polystyrene/maleic acid resin.

EXAMPLE 2

80 parts polyethylene granulate, with a melting point of 110° C. is kneaded together at a temperature of 140° C. with 1 part Porofor (Reg. TM) KL3-2014, a modified azodicarbonamide, of the company Bayer AG, which has a dissociation temperature 165° C. It is then applied as a layer of 0.002 mm on a polyester carrier, forming the substrate 9. A layer of 0.003 mm thickness of polyethylene, from a dispersion (30% in ethylacetate/propanol) is then applied, to form layer 7.

EXAMPLE 3

The layer 8 may have a predetermined degree of moisture.

200 g cellulose, with a molecular weight of 1100 is stirred in 1 liter water, while adding 0.01% carboxymethylcellulose, with a substitution degree of 0.5). The mixture is then brought to a pH of 6 by NAOH and mixed for 3 hours in a ball mill. The mixture is applied is a layer 8 on the substrate 9 by painting or layer application, and then doctored. The substrate 9 for the mixture is a polyester foil, which has been rendered hydrophilic by a corona discharge. After pre-drying with hot air to approximately 60% dye or coating content, the so-coated foil is treated by pressure and dry-rolling and subsequent hot-air treatment to a remaining moisture content of between 3–4%. A spraying device then applies a little more moisture so that a final dampness of 8% is reached.

The finished layer 8 will have a thickness of 0.006 mm.

An hydrophobic layer 7 can then be applied from a dispersion, in accordance with Example 2.

The release layer 10, if applied therebetween, should have good release characteristics at the side facing the coating 7, in order to facilitate release of molten material or substance particles.

The meltable substance is hydrophobic and has oleophilic characteristics, that is, will accept fatty ink.

The printing forme 1, in the region below contact with the foil 4, has a continuous surface which is hydrophilic, that is, water-accepting. A suitable surface is a plasma or flame-sprayed ceramic, a surface such as chromium, copper or the like which, due to its surface roughness has a higher adhesive force to the molten substance 7, 7' than the layer 8 or 10, respectively.

OPERATION

The image recording element 3, which may also be termed a recording head, receives imaging control data from a suitable data source or control unit C. In accordance with the data, heater elements 2 immediately opposite the back side or lower side of the carrier layer 9 of the foil 4 are heated by application of energy thereto. The energy derived from the heater elements 2 passes first through the substrate 9, 9', respectively, the layer 8, 8', respectively, the layer 10, if provided, and melts a tiny region from the substance 7, 7', respectively. If, in the region of contact line, due to precisely maintained dimensions, all components and layers have contact with the surface of the forme cylinder 1, a portion 7*a* from the layer 7 is received by the cold surface of the forme cylinder 1 and immediately solidifies thereon. The portion 7*a* on the surface of the forme cylinder, due to their oleophilic characteristics, then forms the regions or spots at which, later on, ink will be accepted by the forme cylinder 1, to be transferred, for example directly or via an offset cylinder, to substrate, such as paper, for example.

Upon melting of the layers 7, 7', in the specific region opposite the heater element, the temperature continues to rise until the response or threshold temperature of the layer 8, 8' is reached. At this temperature, the layer 8, 8' will expand in volume, for example by foaming. As the layer 8, 8' rises, and becomes thicker, which essentially occurs due to gas bubbles, for example air bubbles arising upon foaming, which have poor heat conductivity, further application of heat to the layer 7, 7' is interrupted while, simultaneously, the molten layer 7, 7' is pressed against the surface of the forme cylinder, where the molten region will adhere and solidify.

Figure 1:
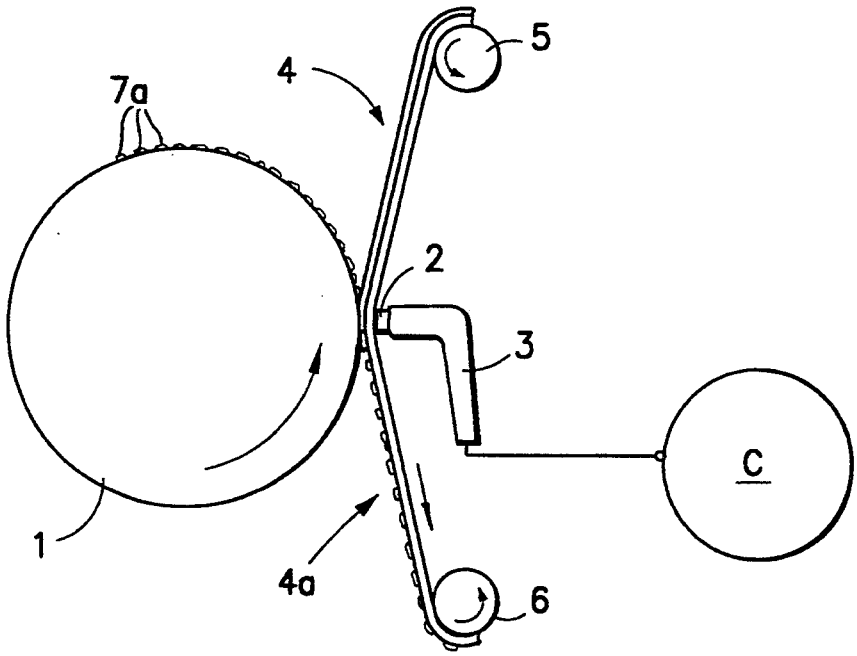

Depending on the characteristics of the layer 8 or 8', respectively, gas or steam bubbles may form, the effect of which is the same as that of the foam layer 8. Steam or water vapor bubbles will re-form into water moisture upon cooling, and water will condense out. This has the additional advantage that the foil after it has been used will not have a surface of different height, or be uneven, and thus can be handled easier. The uneven surface, due to the foaming, is shown at 4a in FIG. 1.

The quality of transfer, that is, the sharpness of contours of the image particles transferred to the surface of the forme cylinder 1, does not depend on the edge sharpness or contour of the foamed region but, rather, only on the edge sharpness or contour of the molten region of the substance 7, 7', respectively.

It has been found that the thermally volume expandable layer is capable of compensating for tolerances of the components, that is, distance between the recording head 3 and the cylinder 1 of up to about 1 mm. These tolerances may arise due to variations in the thickness of the substrate layer 9, dimensions of the recording head 3, layer thicknesses on the substrate 9, and tolerances of the surface of the cylinder 1.

A suitable release layer 10, between the top surface of layer 8' and the under-surface of layer 7' can be applied after layer 8' is completely finished and dry; it may, for example, be a layer of 0.001–0.002 mm thickness, of a low melting (40° C.–80° C.) natural was (e.g. carnauba wax, paraffin wax) applied, for example, by spreading-on, flowing-on, with or without subsequent doctoring to maintain the respective thickness.

Various changes and modifications may be made within the scope of the inventive concept.

All references in this application to "parts" means: parts by weight.

I claim:

1. Printing apparatus comprising, in combination:

a printing forme carrier (1) having a hard hydrophobic particle-accepting surface, a thermal recording head (2, 3) providing heated points or spots, and a thermal transfer foil for transferring image-carrying hydrophobic particles from the foil on the printing forme carrier (1) by spotted application of heat to said foil by said thermal recording head, wherein said foil is formed by a substrate (9, 9') and a layer (7, 7') of a meltable hydrophobic substance, and said thermal recording head (2, 3) is positioned with reespect to the printing forme carrier (1) with spacing to permit passage of said thermal transfer foil (4) therebetween, optionally under pressure and, upon application of heat by said recording head, causing melting of the meltable substance for transfers to and adhesion on the particle-accepting surface of the printing forme carrier (1), and wherein, in accordance with the invention, means are provided for compensating for variations in spacing or pressure between the printing forme carrier (1) and said recording head (2, 3), with the foil (4) therebetween, said compensating means comprising an intermediate layer (8, 8') located between the substrate (9, 9') and the meltable substance layer (7, 7') of the foil (4), which intermediate layer (8, 8') includes a material which is thermally volume-expandable and which has a volume expansion threshold temperature which is higher than the melting point of the meltable substance.

2. The printing apparatus of claim 1, wherein said foil (4) further includes a thin release layer (10) between the intermediate layer (8') and the meltable substance layer (7').

3. The printing apparatus of claim 1, wherein the volume of said intermediate layer (8') of the foil expands under application of heat by foaming.

4. The printing apparatus of claim 1, wherein the volume of said intermediate layer (8) of the foil expands under application of heat by forming hot gas bubbles.

5. The printing apparatus of claim 1, wherein said intermediate layer includes moisture;

and wherein the volume of said intermediate layer (8) of the foil expands under application of heat by forming steam from included moisture.

6. The printing apparatus of claim 1, wherein said intermediate layer (8) of the foil is moisture containing and, upon application of heat, forms steam bubbles.

7. The printing apparatus of claim 1, wherein said intermediate layer (8) of the foil comprises a thermoplastic layer of a mixture of thermoplastics, which includes a thermoplastic material and a foaming agent, wherein the foaming agent has a concentration of between about 0.3 to 1.5%.

8. The printing apparatus of claim 1, wherein said intermediate layer (8) of the foil has a thickness of about 0.03 mm, and the meltable substance layer (7) has a thickness of about 0.05 mm.

9. The printing apparatus of claim 8, wherein said layer (7) of the foil is a mixture of polystyyrene/maleic acid resin.

10. The printing apparatus of claim 1, wherein said layer (7) of the foil is a mixture of polystyrene/maleic acid resin.

11. The printing apparatus of claim 1, wherein the intermediate layer (8) of the foil comprises about 80 parts polyethylene granulate, and one part Porofor KL3-2014 with a dissociation temperature of 165° C.; and wherein the meltable substance layer (7) comprises a layer of polyethylene applied from a dispersion.

12. The printing apparatus of claim 11, wherein the intermediate layer (8) of the foil has a thickness of about 0.002 mm, and the meltable substance layer (7) has a thickness of about 0.03 mm.

* * * * *